US005391872A

United States Patent [19]

Itoh et al.

[11] Patent Number: 5,391,872

[45] Date of Patent: Feb. 21, 1995

[54] IMAGE RECORDING APPARATUS USING REPEATEDLY USABLE RECORDING MEDIUM

[75] Inventors: Shinichi Itoh; Tadayoshi Ohno; Takashi Yamaguchi, all of Kawasaki, Japan

[73] Assignee: Kabushiki Kaisha Toshiba, Kawasaki, Japan

[21] Appl. No.: 33,884

[22] Filed: Mar. 18, 1993

[30] Foreign Application Priority Data

Mar. 24, 1992 [JP] Japan ..... 4-065420

[51] Int. Cl.[6] ..... B41M 5/00

[52] U.S. Cl. ..... 250/316.1; 346/76.1

[58] Field of Search ..... 250/316.1; 346/76 R

[56] References Cited

U.S. PATENT DOCUMENTS 5,021,805 6/1991 Imaizumi et al. ..... 346/76 R 5,045,697 9/1991 Schneider ..... 250/316.1

*Primary Examiner*—Jack I. Berman

*Attorney, Agent, or Firm*—Cushman Darby & Cushman

[57] ABSTRACT

According to the present invention, there is provided an image recording apparatus which records and erases a visible image on a recording medium. On the recording medium, the visible image is recorded by supplying first thermal energy thereto, and the recorded visible image is erased by supplying second thermal energy thereto.

4 Claims, 4 Drawing Sheets

IMAGE RECORDING APPARATUS USING REPEATEDLY USABLE RECORDING MEDIUM

BACKGROUND OF THE INVENTION

1. Field of the Invention

The present invention relates to a recording device for recording/erasing a visible image on/from a recording medium with which recording or erasing of the visible image can be repeatedly performed by opacifying or transparentizing the medium, a thermal energy.

2. Description of the Related Art

A permanent image is recorded on a conventional hard copy by forming an image on a recording medium such as a sheet of paper externally, with a developer, such as ink or toner, or a visible image may be formed on a recording layer which is provided on a base material such as thermosensitive recording paper.

However, recently, in accordance with setting-up of various types of networks, and the widespread of facsimile and copy machines, the amount of recording medium in use has been drastically increased, causing social problems such as the destruction of nature including destruction of forests, and refuse disposal. In consideration of the problems, there rises a great demand for recyclable recording paper and reduction of the consumption amount of recording medium. Consequently, great attention is presently being paid to recyclable recording media upon which recording/erasing can be repeatedly performed.

As a recyclable recording medium there is proposed a recording medium which can reversibly switch between transparent and opaque states in accordance with its temperature.

When the temperature of the recording medium in a transparent state at room temperature T1 is heated from T1 to temperature zone T4–T5 which is higher than the T1, the medium becomes opaque; That the medium changes its state from the transparent to the opaque state, and maintains the opaque state even after the temperature lowers back to room temperature T1. Further, when the temperature of the recording medium which is opaque state at room temperature is raised from T1 to transparent temperature zone T2–T3 (T1<T2–T3<T4–T5), and then lowered back to room temperature T1, the medium changes from the opaque state to the transparent state where it remains. Thus, switching between the transparent and opaque states can be repeatedly carried out.

A report on deterioration of resolution when the above-described method for recording via such a recording medium was repeatedly performed with a thermal head, is repeated.

Further, there is proposed a display revising device for displaying/erasing data on a display using a thermo-reversible recording medium. The revising device includes thermal erasing means for thermally erasing data on the display, and thermal recording means for thermally recording data. A specific example thereof is a device for recording/erasing data on/from a data recording card having a thermo-reversible recording layer by use of a heat roller (thermal erasing means) and a thermal head (thermal recording means).

There is also proposed a recording material in which a leuco-compound which exhibits a reversible variation in color tone by means of heat energy is employed as a color development source.

However, regarding thermal erasing means such as the heat roller mentioned above, it is necessary to maintain the temperature of the heat roller at the optimum value. Since the heat roller having a large heat capacitance is used to maintain a constant temperature, the size of the device is inevitably large.

Since the heat capacitance is large, there is a long delay from when the device is turned-on until when the device is ready to start an operation. Further, the temperature of the device must be maintained at constant even when recording/erasing operations are not carried out, resulting in waste of electrical power.

In a recording device having separate conveying means for each of the thermal recording means and the thermal erasing means, it is likely that the motion speeds of both conveying means differ from each other. When the device is made to have a structure in which a recording medium is interposed between both recording and erasing means so as to make the size of the device small, a slip (trace) is caused on the recording medium due to the difference between both means in motion speed. The slip (trace) causes problems including displacement of a recorded image, deterioration of an image caused by opacification of one section to be erased, due to concentration of heat to the section, and wear-off of a recording medium in a short time by heat.

SUMMARY OF THE INVENTION

The purpose of the invention is to provide an image recording apparatus with less slip of image during conveying of a recording medium, less image quality deterioration, wearproof against heat, a reduced size, a quick stand-by of operation, and reduction of power consumption.

The above-mentioned purpose can be achieved by an image recording apparatus comprising: means for conveying a recording medium on/from which a visible image is recorded by supplying first thermal energy thereto, and the recorded visible image is erased by supplying second thermal energy thereto; means for supporting and guiding the recording medium being conveyed by conveying means; means, provided on the supporting means, for erasing the visible image by supplying the second thermal energy to the recording medium being conveyed; and means, provided on the supporting means such as to be adjacent to the erasing means on a downstream side of a conveying direction of the recording medium, for recording a visible image by supplying the first thermal energy to the recording medium being conveyed.

There is also provided, according to the invention, an image recording apparatus wherein the erasing means employs a film-like thermal generating resistance.

With the above-described structure of the invention, both erasing and recording means are arranged on the same supporting means. There is therefore no difference in motion speed between these means, and a distance in which the means are conveyed is shortened. Further, the recording means can be heated before the recording medium cools down, where the recording medium was heated by the erasing means. Consequently, a slip trace on the recording medium, which may be created during conveyance of the medium, can be prevented, thus displacement of an image due to the slip during conveyance can be suppressed. Further, deterioration of the image quality, and wear-off of the medium due to heat can be suppressed, and the size of the device can be reduced.

Moreover, since the above-mentioned film-like thermal generating resistance is used in the erasing means, the size of the erasing means can be made very small as compared to the conventional case where heat rollers are used, and the time required for the apparatus to rise, which requires a certain temperature, can be shortened. Consequently, the erasing means does not have to be made to generate heat all the time for erasing an image recorded on a recording medium, contributing to reduction of the size of the apparatus, and the power consumption thereof.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

Detailed Description of the Preferred Embodiments

An embodiment of the present invention will now be described in detail with reference to accompanying drawings.

Figure 1:
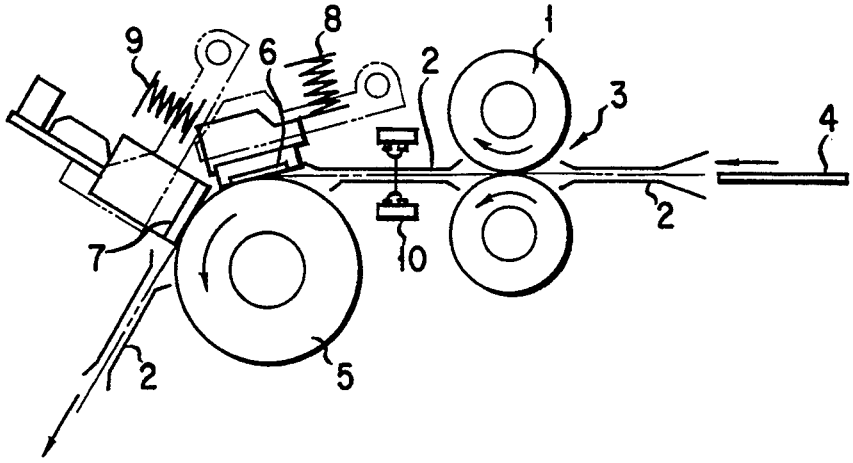
FIG. 1 is a cross section showing the structure of a recording apparatus according to an embodiment of the present invention.

FIG. 1 schematically shows the structure of a recording apparatus according to an embodiment. As can be seen in the figure, a pair of convey rollers 1, and a convey guide 2 constitute a convey path 3, by which a recording medium 4 is conveyed in the direction indicated by the arrow shown in the figure. At the mid-portion of the convey path 3, there is provided a platen roller 5 serving as a support/guide member. The recording medium 4 conveyed is supported and guided by the platen roller 5.

On the platen roller 5, there are provided a erasing heat generator head 6 serving as thermal erasing means and a thermal head 7 serving as thermal recording means. Those heads are positioned in the mentioned order along with the direction of conveying the recording medium 4. The erasing heat generator head 6 and the thermal head 7 are relatively angled at about 45° with reference to the platen roller 5 having an outer diameter of about 24 mm, and are arranged along the convey path by a distance of about 12 mm away from each other.

Both the heat generator head 6 and the thermal head 7 are pressed against the surface of the platen roller 5 by means of springs 8 and 9, respectively, at a predetermined pressure.

On the section of the convey path 3 before the platen roller 5, there is provided a position detector 10 for optically detecting the position of the recording medium 4 being conveyed.

With the structure in which the erasing generator head 6 and the thermal head 7 are arranged on the same platen roller 5, the size of the apparatus can be made smaller than the case where an erasing heat generator head and a thermal head are provided on separate platen rollers.

Figure 2:
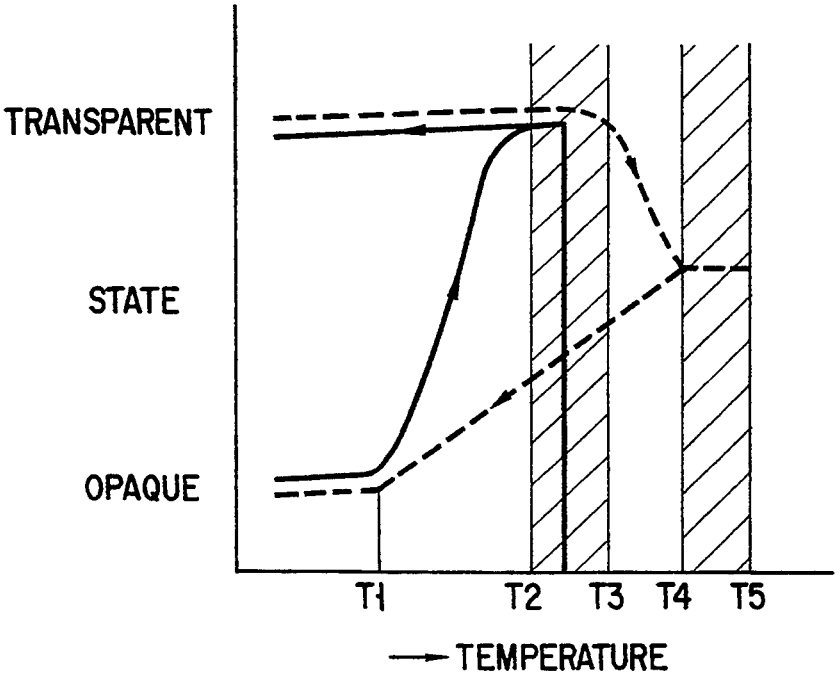
FIG. 2 is an explanatory diagram illustrating the states of a recording material which can switch between opaque and transparent states in accordance with temperature hysteresis.

As the recording medium 4, a sheet material which switches between the transparent and opaque states in accordance with the temperature set by application of heat, and is formed of a substrate coated with a recording material which can be repeatedly used. As is shown in FIG. 2, when the recording material in the transparent state is heated from a temperature T1 to T4–T5, the material switches its state from transparent to opaque, and even after the material cools down back to temperature T1, the material remains in the opaque state. When the temperature of the recording material is increased once again from T1 to T2–T3, and then decreased back to T1, the recording material switches its state from opaque to transparent, and maintains the transparent state. The switching of the state can be repeatedly performed.

The state changing temperature T214 T4 illustrate in FIG. 2 is not always constant and somewhat varies along with the component ratio of a recording material to be used, and the type of an additive. In the above-described embodiment, a recording medium which exhibits a characteristic in which the medium is transparentized at 70°–100° C. (T2–T3) and is opacified at 110°–180° C. (T4–T5) when a heat plate is applied to the medium for 2 seconds.

Figure 3:
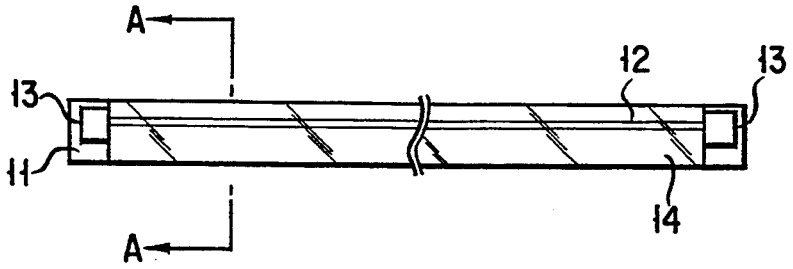
FIG. 3 is a front view schematically showing an erasing heat generating head.
Figure 4:
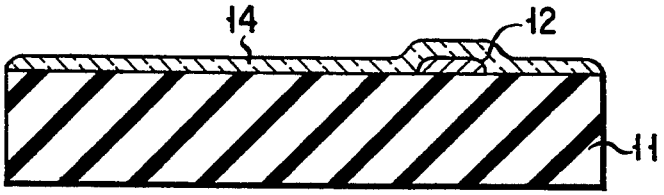
FIG. 4 is a cross section along the line A—A in FIG. 3.

FIGS. 3 and 4 show details of the structure of the erasing heat generator head 6. The erasing heat generator head 6 has a thick film heat generator resistance 12 formed on the surface of a 1 mm-thick ceramic substrate 11, when said resistance 12 has a belt-like shape with a width of 1 mm and a thickness of 20 μm and serving as a heat generating portion. There is also a current supply electrode 13 formed on both ends of the resistance. Note that the length of the thick-film heat generating resistance 12 between electrodes 13 is longer than a width of the recording medium being guided by the erasing heat generator head 6. Therefore, one of the thick-film heat generating resistance 12 can erase all image on the whole surface of the recording medium. Further, in order for improvement of the surface condition and for abrasion-proof, a protection film 14 made of crystallized glass is formed on the surface of the substrate 11 except for the sections of the current supply electrodes 13.

As electricity is supplied to the thick-film heat generating resistance 12 via the current supply electrodes 13, the thick-film heat generator resistance 12 generates heat. The generated heat is applied to a conveyed recording medium 4 while brought into contact with the erasing heat generator head 6, for erasing a developed image.

It should be noted here that although a thick-film heat generating resistor is used in the embodiment as a heat generating portion, an image can be erased in a similar manner by use of a thin-film heat generating resistor.

The recording/erasing operation with the above structure will be described.

When a recording medium 4 is inserted from an insertion opening (not shown), the medium is conveyed by the convey rollers 1 and the convey guide 2 from the position detector 10 to the erasing heat generator head 6. The recording medium 4 is conveyed on the platen roller 5 while being pressed thereagainst such as to set an appropriate timing based on an output signal from the position detector 10. Then, heat energy sufficient to transparentize an image by the erasing heat generator head 6 is supplied to the recording medium, so that it switches to the transparent state. Note that regardless of whether or not a visible image is formed on a recording medium 4 before insertion, heat energy sufficient to transparentize the recording medium 4 is supplied thereto.

While the transparentizing energy is being supplied by the erasing heat generator head 6 to the recording medium 4, the recording medium is conveyed on the common platen roller 5, where the medium is transparentized from the forward end side. The transparentized portion is successively fed to the thermal head 7, and a visible image is recorded on the portion. More specifically, as a pulse voltage which is based on an image signal output to the thermal head 7 is selectively applied, heat energy sufficient to opacify a recording medium 4 is supplied to partially opacify the recording medium 4, thereby forming a visible image thereon. Thus, in the recording medium 4, a visible image is formed by the contrast between a portion of visible back ground color by transparentized and a portion of opacified.

When the same recording medium 4 is used once again the process is repeated. That is, the recording medium 4 is inserted into the apparatus, and conveyed by the convey rollers 1 and the convey guide 2, to the erasing heat generator head 6, where the opaquely developed image previously formed is erased. A new visible image is then recorded by the thermal head.

With the above-described operation, the recording medium 4 can be repeatedly used as many times as desired. Since the recording medium 4 is conveyed by the platen roller 5 commonly used by the erasing heat generator head 6 and the thermal head 7, no relative speed difference is created. Therefore, displacement of an image due to slip of a recording medium, or opacification of a to-be-erased portion, which occurs in the case where separate platen rollers are provided, is prevented. Further, the life time of the recording medium 4 can be prolonged.

In the above-mentioned embodiment, the recording medium 4 reaches the thermal head 7 by conveying the medium by only about 12 mm after applying transparentizing heat thereon by the erasing heat generator head 6. The motion speed is set to, for example, 40 mm/s, and therefore it takes about 0.3 seconds for the recording medium 4 to reach the thermal head 7 from the erasing heat generator head 6.

By increasing the motion speed of the medium, there can be obtained a substantially similar effect to the case where the distance between the two heads are shortened.

Figure 5:
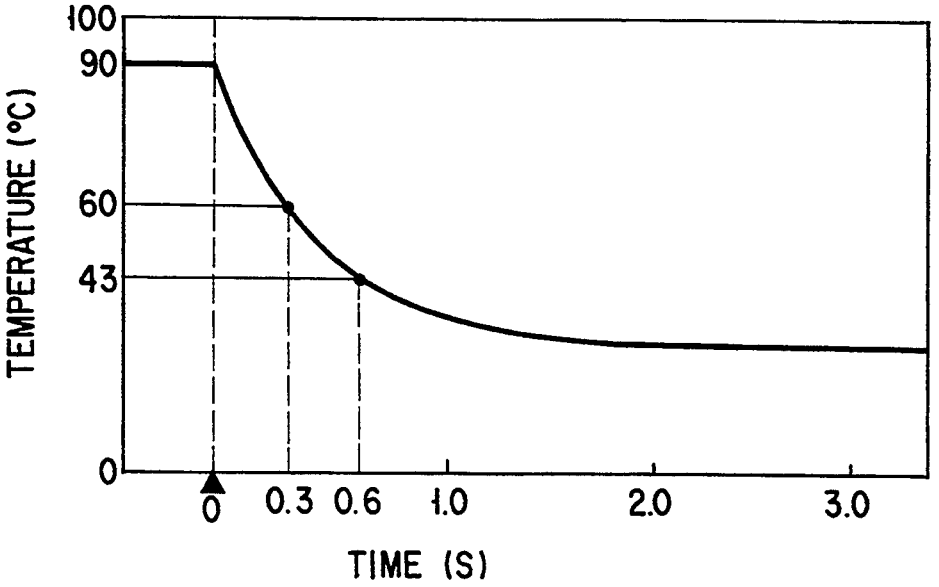
FIG. 5 is a graph showing cooling down of the recording medium after heated for transparentizing by the erasing heat generating head.

FIG. 5 shows an example of the cooling-down state of a recording medium 4 once heated by the erasing heat generator head 6° to 90° C. (transparentizing temperature). It can be understood from this figure that when the recording medium 4 is heated by the thermal head 7 before it has cooled from application of transparentizing heat by the erasing generator head 6, the amount of heat applied from the thermal head 7 itself for opacifying the recording medium 4 can be reduced.

Therefore, the relative distance between the erasing heat generator head 6 and the thermal head 7 should preferably be as close as possible. As can be seen from FIG. 5, the temperature of the recording medium 4 after 0.3 seconds of application of the transparentizing heat by the erasing heat generator head 6 is about 60° C. In the case where separate platen rollers each having an outer diameter of 24 mm are used along with an erasing heat generator head and a thermal head of the same types as those of the above embodiment, at least 24 mm of a relative distance is necessary in order to achieve the characteristic shown in FIG. 5. Further, for the same motion speed, it takes about 0.5 seconds for a recording medium to reach the thermal head from the erasing heat generator head.

According to FIG. 5, the temperature of the recording medium 6 after 0.6 seconds of application of the transparentizing heat by the erasing heat generator head 6 is about 43° C. The temperature difference between the case of one common platen roller, and that of separate platen rollers, is about 17° C. Consequently, the heat energy consumed by the thermal head 7 can be made smaller by the amount of energy corresponding to a temperature difference of 17° C. when one common platen roller 5 is used instead of separate platen rollers.

With the thermal head (8 dots/mm) used in the embodiment, the consumption energy in the case of one common platen roller was 0.36 mj/dot, whereas that in the case of separate rollers was 0.43 mj/dot. Thus, about 16% of energy saving can be achieved at the thermal head section by pre-heating (heat-remaining) effect.

In the erasing heat generator head 6 used in the embodiment, the heat generator resistance 12 is made to generate heat by supplying electrical pulses so as to heat the recording medium 4. By controlling the pulse width, the temperature is controlled to erase the visible image on a recording medium 4. More specifically, the erasing heat generator head 6 is quickly heated up to a transparentizing temperature (T2–T3) immediately before the recording medium 4 is brought to the heat generator head 6. Thus, when the recording medium 4 reaches the heat generator head 6, the generator head 6 is already at the transparentizing temperature (T2–T3). Therefore, once it has reached the transparentizing head, a constant electrical pulse is continuously applied to the erasing heat generator head 6 so as to transparentize the recording medium 4.

Figure 6:
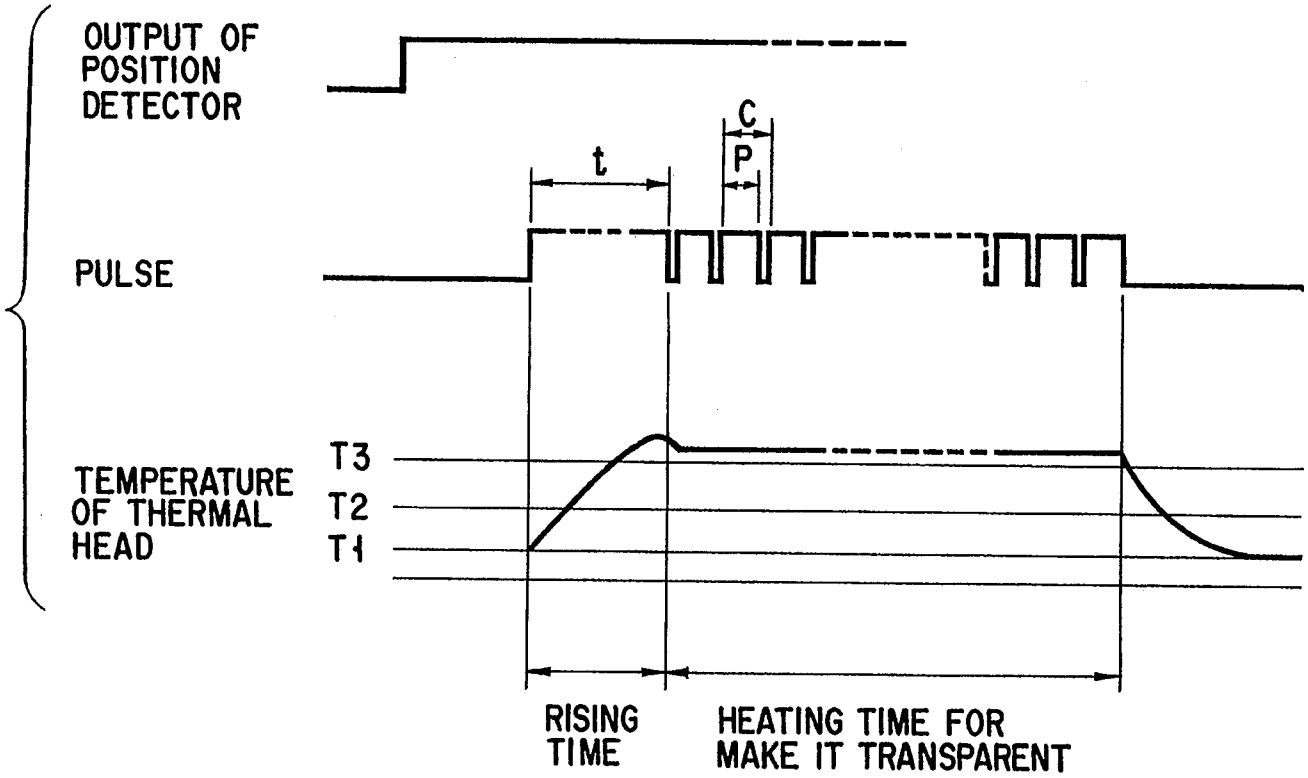
FIG. 6 is a diagram showing the relationship between an pulse indicating an electric conduction to the heat generating resistance of the erasing heat generating head, and variation of the temperature of the erasing heat generating head.

FIG. 6 shows the correlation between an electric pulse and a temperature change of the erasing heat generator head 6. In the embodiment, before an actual recording, 0.6 seconds of a continuous current supply was performed for the apparatus to rise. When the transparentizing temperature is obtained, constant heating at a pulse cycle (C) of 10 ms and a pulse (electricity conducting) time period (P) of 9 ms is supplied. The supply of current is completed when the amount of electrical pulse corresponding to the length of the recording medium 4 is output.

Figure 7:
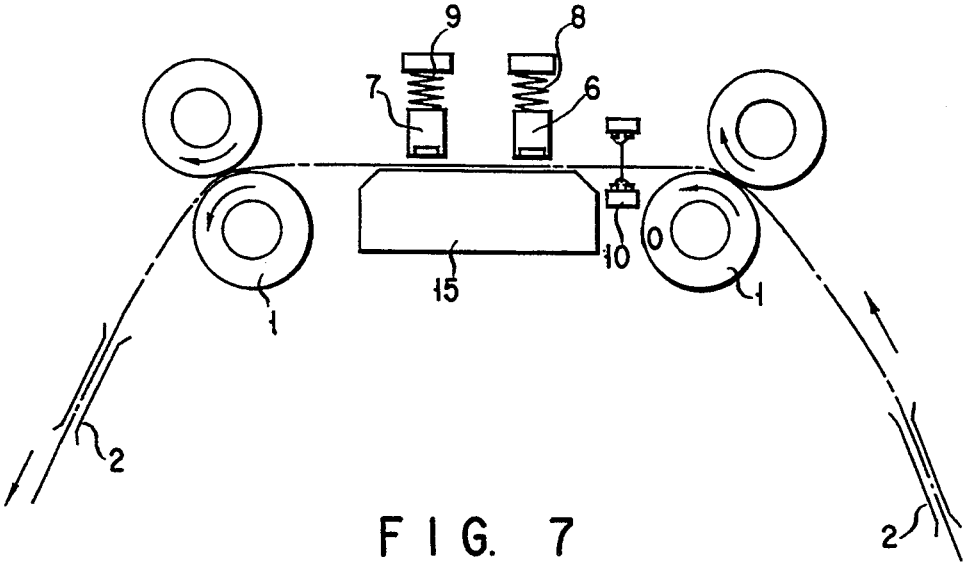
FIG. 7 is a cross section showing the structure of a recording apparatus according to another embodiment of the invention.

FIG. 7 is a cross section showing a recording apparatus according to another embodiment of the present invention. As can be seen in this figure, convey guides 2 and two pairs of convey rollers 1 constitute a transfer path 3 on which a recording medium 4 is conveyed in the direction indicated by arrows. At the center portion of the convey path 3, there is provided a flat-plate support/guide member 15 for supporting and guiding the recording medium 4. An erasing heat generator head 6, and a thermal head 7 are pressed against the support/-guide member 15 at a predetermined pressure by means of springs 8 and 9. In the middle of the convey path 3, there is provided a position detector 10 for optically detecting the position of the recording medium 4.

With the above-described structure, two heads 6 and 7 can be arranged to be close to each other as in the case where these heads are provided on a platen roller. Similarly, displacement of images due to slip of recording media during conveyance, deterioration of quality, and wear-off due to heat are suppressed, and also downsizing of the apparatus and energy saving can be achieved.

Figure 8:
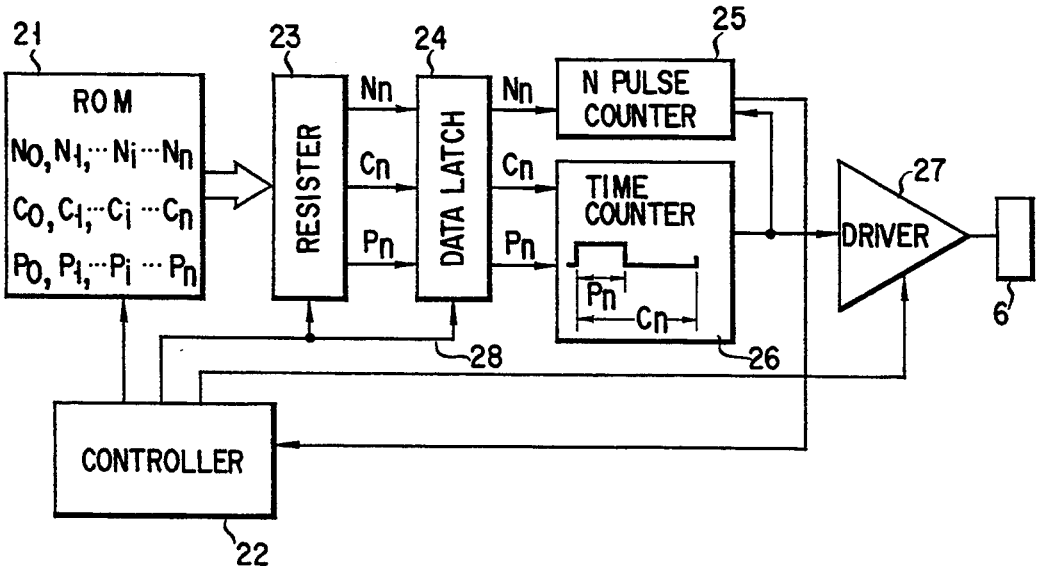
FIG. 8 is a block diagram of a driver circuit for a heat generating head of the invention.

FIG. 8 is a block diagram showing a driver circuit of an erasing heat generator head according to the invention. In this figure, the number of pulses in one electric pulse set, a pulse cycle, and an current-supply time are indicated, respectively as Nn, Cn, and Pn. Nn, Cn, and Pn are already written in ROM 21 as data, and data Ni, Ci, and Pi are read out by supplying an address signal to ROM 21 using a controller 22. The can therefore be consecutively sent to a register 23 and a data latch 24. To the register 23 and the data latch 24, a data latch control signal 28 is transmitted by means of the controller 22, and the data is then sent to both an N pulse counter 25, and an current-supply time determination counter 26. In the current-supply time determination counter 26, a current-supply time corresponding to one pulse is determined by data Ci and Pi. The determined data for the current-supply time is input to the driver portion 27 so as to drive the erasing heat generating head 6. At the same time, the number of pulses is counted by the N pulse counter 25. When data Ni is counted, the signal is sent to the controller 22. The controller 22, upon reception of the data, controls the next address signal, the register 23 and the data latch 24. Further, when the counter counts the number of current-supply pulses corresponding to the length of the recording medium, the current supply is stopped. In this embodiment, values are set as: $Cn=10$ ms at constant, $P_0=9$ ms, $N_0=30$, $P_1=2$ ms, and $N_1=250$.

In this embodiment, the recorded image is formed by the opaque state of the recording medium, but may be formed by the transparent state by setting the states reversely. For example, when the opaque state is taken as an erased status, the erasing heat generating head is controlled to heat the recording medium in an opacifying temperature range, and the thermal head is controlled such as to heat the medium in a transparentizing temperature range.

The recording material which can be used in the present invention is not limited to those used in the above-described embodiments. A material fabricated from a leuco-compound dye which reversibly changes its color tone by control of heat energy as a color-emitting source, can be also used.

As described above, according to the present invention, there is provided a recording apparatus which can suppress the displacement of images due to slip of recording media while being conveyed, the deterioration of image quality, wear-off of media by heat, and the like.

Further, according to the invention, there is also provided a recording apparatus which can be downsized more than conventional ones, with a shorter rising time, and a less consumption of power.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image recording apparatus comprising:

means for conveying a recording medium on which a visible image can be recorded and from which a visible image can be erased, said conveying means including a platen roller provided in a mid-portion of said conveying means for supporting said recording medium being conveyed;

pulse signal driven erasing means, positioned opposing said platen roller, for erasing a previously recorded visible image by supplying a second thermal energy to said recording medium being conveyed;

means for determining a number of pulse signals for driving said erasing means;

means for determining a current-supply cycle of said pulse signals;

means for determining a current-supply time period of said pulse signals;

means for driving said erasing means when said determinations are received from each of said determining means; and recording means, positioned adjacent to said erasing means and opposing said platen roller, for recording a visible image on said recording medium by supplying a first thermal energy to said recording medium after it has been conveyed beyond said erasing means.

2. An image recording apparatus comprising:

means for conveying a card-like recording medium upon which a visible image can be recorded;

a single supporting member for supporting the recording medium conveyed by conveying means;

erasing means, positioned opposing said supporting member, for supplying second thermal energy to said recording medium to erase a visible image previously recorded thereon, said erasing means including a single heat generating resistance which develops said second thermal energy in response to pulse signals, thereby erasing an entire surface of said recording medium;

recording means, positioned opposing said supporting member and adjacent to said erasing means, for recording a visible image on said recording medium by supplying first thermal energy thereto; and means for generating pulse signals to drive said heat generating resistance.

3. An image recording apparatus according to claim 2, further comprising:

means for determining a number of pulse signals required for driving the erasing means;

means for determining a current-supply cycle of the pulse signals;

means for determining a current-supplying time period of the pulse signals; and means for controlling the driving means in accordance with the determination of each of the determining means.

4. An image recording apparatus comprising:

means for conveying a recording medium upon which a visible image can be recorded;

a supporting member for supporting the recording medium being conveyed by the conveying means;

means, positioned to oppose the supporting member, for recording a visible image by supplying first thermal energy to the recording medium being conveyed;

means, positioned to oppose the supporting member, for erasing a previously recorded visible image by supplying second thermal energy to the recording medium being conveyed, the erasing means including a linear resistance which is oriented orthogonal to a recording medium conveying direction; and means for driving the erasing means with pulse signals to heat the linear resistance.

* * * * *